US005920755A

United States Patent [19]

Nelson

[11] Patent Number: 5,920,755

[45] Date of Patent: Jul. 6, 1999

[54] ELECTROPHOTOGRAPHIC COLOR PRINTER WITH BELT-TO-BELT TONER TRANSFER AND TOP-SIDE PAPER PATH

[75] Inventor: William E. Nelson, Dallas, Tex.

[73] Assignee: Texas Instruments Incorporated, Dallas, Tex.

[21] Appl. No.: 09/003,375

[22] Filed: Jan. 6, 1998

Related U.S. Application Data

[60] Provisional application No. 60/034,684, Jan. 6, 1997.

[51] Int. Cl.[6] ..... G03G 15/01

[52] U.S. Cl. ..... 399/298; 399/165; 399/302; 399/304

[58] Field of Search ..... 399/124, 107, 399/160, 162, 165, 298, 300, 301, 302, 303, 304, 125, 381, 388

[56] References Cited

U.S. PATENT DOCUMENTS

| | | | |
|---|---|---|---|
| 4,933,727 | 6/1990 | Mizuma et al. | 399/298 |
| 4,956,676 | 9/1990 | Fukae et al. | 399/302 |
| 5,075,730 | 12/1991 | Hoshi | 399/302 |
| 5,077,576 | 12/1991 | Stansfield et al. | 399/160 X |
| 5,151,745 | 9/1992 | Durland et al. | 399/304 |
| 5,245,387 | 9/1993 | Kubo et al. | 399/223 X |
| 5,270,769 | 12/1993 | Satoh et al. | 399/301 |
| 5,298,946 | 3/1994 | Haneda et al. | 399/124 X |
| 5,557,393 | 9/1996 | Goodman et al. | 399/223 |
| 5,697,031 | 12/1997 | Kamiya et al. | 399/301 |

*Primary Examiner*—Arthur T. Grimley
*Assistant Examiner*—Sophia S. Chen
*Attorney, Agent, or Firm*—Charles A. Brill; Frederick J. Telecky, Jr.; Richard L. Donaldson

[57] ABSTRACT

A color electrophotographic printer (100) having a vertical photoreceptor belt (111) and a horizontal transfer belt (120) at the top of the printer. The result is a "T-shape" belt-to-belt toner transfer configuration with a top-side paper path. Color developer cartridges (117) are vertically stacked along one side of the photoreceptor belt (111) and an oversized black developer cartridge (116) is placed on the other side.

20 Claims, 4 Drawing Sheets

ELECTROPHOTOGRAPHIC COLOR PRINTER WITH BELT-TO-BELT TONER TRANSFER AND TOP-SIDE PAPER PATH

This application is a provisional application Ser. No. 60/034,684, filed Jan 6, 1997.

TECHNICAL FIELD OF THE INVENTION

This invention relates generally to electrophotographic printers, and more particularly to a belt-to-belt printer having a top-side paper path.

BACKGROUND OF THE INVENTION

Electrophotographic (also called xerographic) copiers were first introduced in 1959. More recently the electrophotographic technology has been extended to printers. An excellent text on electrophotography is *Electrophotography and Development Physics*, by L. B. Schein (2d ed. 1996, Laplacian Press).

A typical modern electrophotographic ("EP") printer uses some sort of processor to interpret a program representing the image to be printed. The interpretation usually involves conversion of the program into a bitmap, which determines a pattern of light that will expose a photoreceptor, such as the surface of a drum or belt. A copier may operate in analog fashion by imaging light reflected from the document to be copied onto the photoreceptor or it may use digital data (acquired by digitizing the document) in the same manner as a printer.

For both copiers and printers, the exposure of the photoreceptor results in its acquiring a charge pattern. The photoreceptor then passes a toner dispenser and attracts toner particles to the areas corresponding to the charge pattern. The photoreceptor transfers the toner to a print medium such as a piece of paper. The toner is fused to the paper, usually with heat, and the paper exits the printer.

EP copiers and printers have been developed with a variety of design choices. One design choice is with respect to whether the photoreceptor surface is on a drum or belt. Another design choice is with respect to the paper transport mechanism, which may be a drum or a belt. Regardless of the configuration of the photoreceptor and the paper transport, at some point, toner from the photoreceptor is transferred to the paper. Sometimes, instead of transferring toner directly to paper, an intermediate drum or belt surface is used as an intermediate media. In theory, four possibilities exist for transferring toner from the photoreceptor to either the paper or intermediate media: drum-to-drum, drum-to-belt, belt-to-drum, or belt-to-belt.

The choice of belts versus drums is related to the configuration of the paper path. A straight paper path is thought to reduce the likelihood of paper jams. The benefits of a straight paper path with top-side access to the paper path have been successfully marketed for black and white printers.

SUMMARY OF THE INVENTION

One aspect of the invention is a "develop and transfer assembly" (as defined herein) for an electrophotographic color printer. A photoreceptor belt has a photoconductive outer surface suitable for exposure as a latent image. The photoreceptor belt is substantially oblong in shape, and is vertically positioned within the printer. A number of developer cartridges are positioned adjacent to the photoreceptor belt. For a full-color printer, cartridges for color developer are vertically stacked on one side of the photoreceptor belt, and a cartridge for black developer is placed on the other side. A toner transfer belt is situated substantially perpendicular to and above the photoreceptor belt, such that the photoreceptor belt and the transfer belt form a T-shape. The toner transfer belt receives toner from the photoreceptor belt, and either carries paper or serves as an intermediate transfer media. For full-color printing, the toner transfer belt accumulates toner during four passes of the photoreceptor belt. For spot color printing, there is only one pass.

An advantage of the invention is that it provides the ability to print a large surface area with a relatively compact photoreceptor. The printer is arranged in a manner that is convenient for user access and that does not complicate the operation and interaction of the printer components. The top-side paper path permits a number of options for attaching and registering the paper during color image accumulations. The top-side paper path also provides easy access to the internal parts of the machine for repairs, maintenance, consumables removal, and paper path access. All subsystems may be easily removed from the printer from the top.

The printer's developer cartridges may be designed to operate at the same angle and position with respect to the photoreceptor belt. This simplies the design of the printer and reduces variability from color to color. A cartridge for black developer may be designed separate and different the cartridges for color developer so as to provide for greater volume.

DETAILED DESCRIPTION OF THE INVENTION

The invention described herein is primarily directed to those parts of an electrophotographic printer that perform the toner develop and toner transfer steps of electrophotographic printing. For purposes of this description, a "printer" is any electrophotographic hardcopy device, regardless of whether it is all-digital, for printing and copying, or performs only analog copying. Likewise, "printing" includes any electrophotographic production of hardcopy output. As discussed below, features of the printer include belt-to-belt toner transfer and a top-side paper path.

Figures 1, 1A:
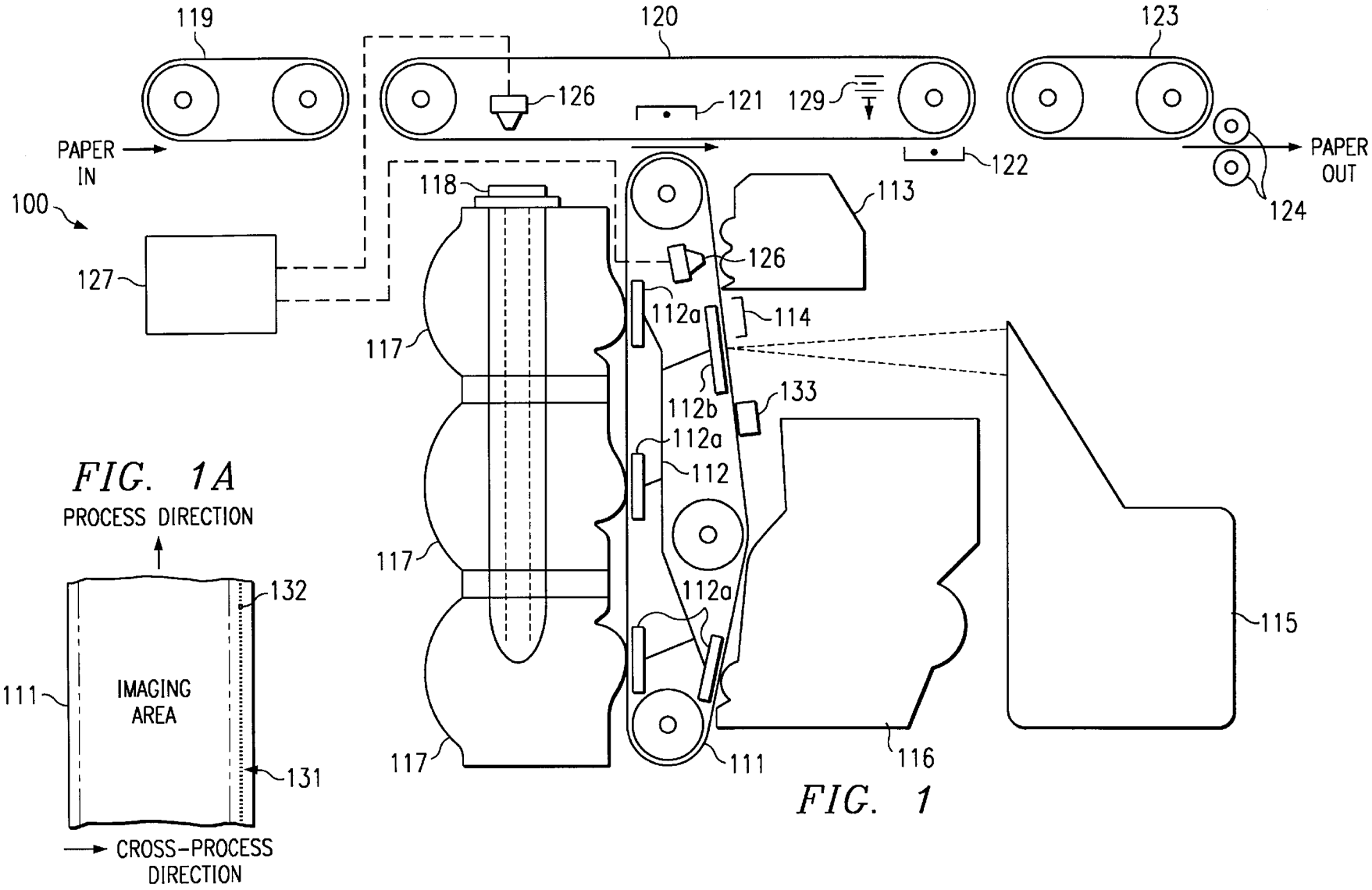
FIG. 1 is a side cross-sectional schematic of an electrophotographic printer in accordance with the invention.
FIG. 1A illustrates the optically readable track that may be placed on the photoreceptor belt or the transfer belt of FIG. 1.

FIG. 1 is a side cross-sectional schematic of an electrophotographic printer 100 in accordance with the invention. Printer 100 is a four-color printer (cyan, magenta, yellow, and black), which, as explained below, sequentially accumulates toner onto transfer belt 120. For printer 100, transfer belt 120 carries paper, and thus, toner is accumulated on paper. This is in contrast to printer 200, discussed below in connection with FIG. 2, which uses transfer belt 120 as an intermediate surface for toner accumulation.

Photoreceptor belt 111, toner cartridges 116 and 117, and transfer belt 120 could be referred to collectively as a "develop and transfer assembly". Although the emphasis herein is on the components of this develop and transfer assembly, the other components of printer 100 are briefly described. It should be understood that with regard to these other components, a number of alternative assemblies are available and could be substituted.

Photoreceptor belt 111 is coated with organic photoconductive ("OPC") material so as to provide the photoreceptor surface. Photoreceptor belt 111 is substantially oblong in its cross-sectional shape and is positioned within printer 100 such that its long dimension is vertical.

A platen system 112 supports belt 111 and provides a number of toner contact points 112*a* as well as an exposure point 112*b*. As an alternative to the contact points of FIG. 1, platen system 112 may comprise conformable roller surfaces or multiple opposing rollers. In the example of this description, where printer 100 has four toner cartridges, there are four toner contact points 112*a*. Photoreceptor belt 111 is removable from printer 100 in the vertical direction, after transfer belt 120 is lifted or otherwise moved from its operating position above photoreceptor belt 111.

A cleaner 113 cleans excess toner from photoreceptor belt 111 after toner transfer to transfer belt 120. A scorotron 114 charges the surface of belt 111.

An exposure unit 115 converts digital information into a pattern of light that discharges the normally insulating photoreceptor belt 111, thereby producing a latent image. A latent image is produced for each of the four colors to be printed, with belt 111 rotating once per color. Exposure unit 115 is suitably registered to photoreceptor belt 111. Exposure unit 115 may be based on laser scan or on spatial light modulator technology. An example of the latter is the DMD (digital micro-mirror) exposure unit developed by Texas Instruments Incorporated. An example of a DMD-based exposure unit is described in U.S. Pat. No. 5,041,851 to William E. Nelson, entitled "Spatial Light Modulator Printer and Method of Operation", assigned to Texas Instruments Incorporated and incorporated herein by reference.

Exposure unit 115 may receive images acquired by scanning a scanned document to be copied (or otherwise acquiring a digital representation), and in this sense, printer 100 can perform copying tasks. Alternatively, printer 100 could be easily modified for conventional light-lens copying, using light reflected from a document to expose the photoreceptor belt 111.

A first developer housing 116 contains black toner. It is high capacity, as compared to three other developer housings 117, which contain color toner. Developer housings 117 contain subtractive toner colors, such as cyan, magenta, and yellow (CMY). Developer housings 116 and 117 are mounted in printer 100 and registered to photoreceptor belt 111 so as to achieve developer gaps. Each developer housing 116 and 117 is positioned along the long dimension of photoreceptor belt 111. An advantage of the invention is that the three developer housings 117 for color toner can be stacked vertically along one side of photoreceptor belt 111. As a result, each cartridge 116 is the same distance from belt 111. Tube 118 has different channels that permit addition of toner to each developer housing 117.

The design of FIG. 1 shows the color developer cartridges 117 stacked on one side of photoreceptor belt 111 and the black developer cartridge 116 on the opposing side. This facilitates the oversizing of the black developer cartridge 116 without loss of compactness of the printer size. However, other configurations are possible.

The developer cartridges 116 and 117 may be for either two-component or monocomponent development. Also, the toner may be of either the non-contacting (toner jumping) type or the contacting type. In the case of the latter, proximity to belt 111 may be accomplished with a small indexing movement. Either the cartridges 116 and 117 may be moved, or the brushes or rollers that carry toner to belt 111 can be moved. In either case, if cartridges 117 are stacked and are therefore all the same distance from belt 111, the indexing is accomplished in the same manner for each. The brushes may be moved from proximity to photoreceptor belt 111 by dynamic means, such as by reversing rotation to collapse a dual component toner magnetic brush.

A paper input belt 119 initializes the paper path. An alternative to belt 119 could be a roller. As indicated, the paper travels "face down" along its path within printer 100.

Toner transfer belt 120 is positioned above photoreceptor belt 111. Transfer belt 120 is substantially perpendicular to photoreceptor belt 111. As a result, photoreceptor belt 111 and transfer belt 120 form a T-shape. Transfer belt 120 carries the paper in a straight horizontal path across the top of printer 100. As indicated above, transfer belt 120 is moveable to provide access to photoreceptor belt 111 and to permit photoreceptor belt 111 to be removed from printer 100.

As paper is carried along its path by transfer belt 120, the paper passes a toner transfer point, where toner is transferred to the paper from photoreceptor belt 111. A transfer corona 121 effects transfer of the developed image to the paper. The point of transfer for images developed on photoreceptor belt 111 is at the apex (top) of that belt. This results in an efficient and reliable paper path.

For a four-color (CYMB) image, transfer belt 120 recirculates the paper four times before releasing the paper to the rest of its path through printer 100. In other words, transfer belt 120 causes the paper to make four passes past the toner transfer point, each time receiving a differently colored image.

Attachment of the paper to transfer belt 120 can be accomplished with several means, such as with mechanical clamping, electrostatic attraction, or vacuum force. The appropriate type of attachment is related to the radius of curvature of belt 120 as defined by end rollers, with a larger radius being more amenable to electrostatic attachment. FIG. 1 illustrates, schematically, attachment by electrostatic attraction mechanism 129. A mechical clamping mechanism (not shown) would have a means for lifting the clamp where appropriate. An example of a suitable clamping means is a leading edge clamp, such as that used in the Xerox Two Roll Transfer Loop system used in the Xerox 5775 color printer.

After transfer belt 120 has circulated the paper once across the toner transfer point once for each color to be printed, the paper is released from transfer belt 120. A paper detach mechanism 122 effects this release and transfer of the paper to an exit carrier belt 123. In FIG. 1, the paper detach mechanism is shown as a separation corona 122, but other mechanical or electrical separation means known in the art of electrophotography, such as "picker fingers", could be used.

Fuser 124 is implemented with any suitable EP technology. FIG. 1 illlustrates fuser 124 in the forms of conventional hot rollers 124.

Synchronization and alignment of belts 111 and 120 may be accomplished with optically readable tracks and read heads. FIG. 1A illustrates a read track 131 coated onto the inner surface of a portion of photoreceptor belt 111. As indicated by the dotted lines, belt 111 is somewhat wider than the imaging area, so that track 131 may be placed alongside the imaging area. Track 131 has at least one encoded section 132, which indicates the position of belt 111 in both the process and the cross-process direction. Transfer belt 120 may be similarly encoded. Track 131 can be implemented as a high resolution, optically encoded track in an ablatable material, similar to those used for optical disks. An example of a suitable track 131 is one having a 7 micron width with 2 micron features. Tracking information can be included to servo the optical readhead.

Referring again to FIG. 1, read heads 126 monitor both the process and cross-process position of belts 111 and 120. This ensures registration of the paper during toner accumulation, as well as belt-to-belt synchronization if the belts are operating at different speeds. For lateral (cross-process) wandering of belt 111 or 120, either the imaging area or the belt position could be adjusted. Synchronization can be accomplished with control unit 127, which is in electronic communication with read heads 126. Control unit 127 has a counter that counts between reads of the same or different encoded sections 132, and has appropriate logic for comparing belt speeds.

Figure 2A:
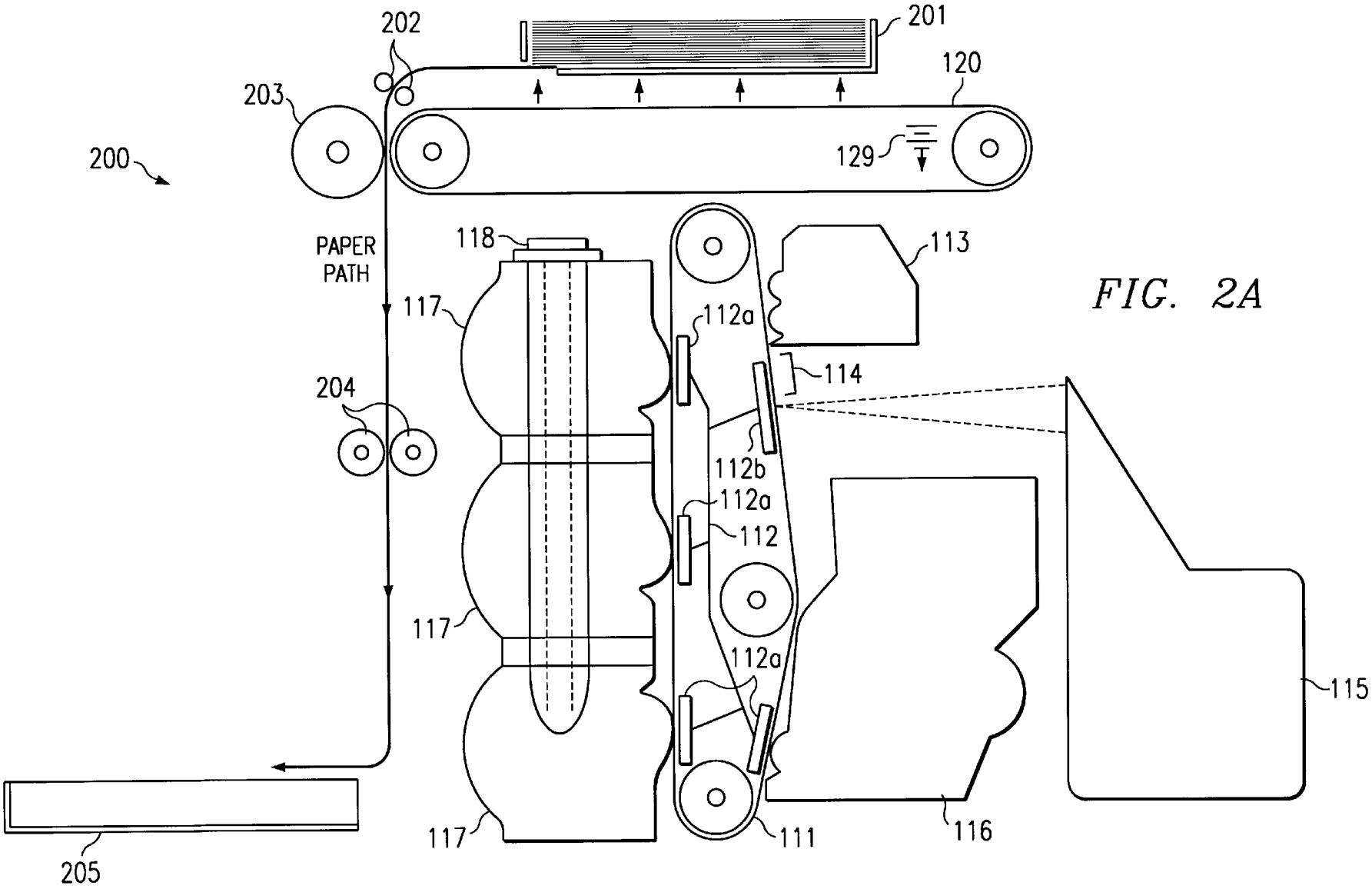
FIGS. 2A and 2B are alternative embodiments of the printer of FIG. 1, where the transfer belt is an intermediate toner transfer surface.

FIG. 2A illustrates printer 200, which is a variation of printer 100. In printer 200, transfer belt 120 is used as an intermediate media for receiving toner from photoreceptor belt 111. The paper is delivered to belt 111 from a top paper tray (not shown). Known air lifting and bottom picking means can be used for delivering individual sheets of paper. Rollers 202 direct the paper downward along a vertical "top-to-bottom" paper path, such that the paper passes past a toner transfer roller 203 and through fuser rollers 204. Thus, the point of transfer for images developed on photoreceptor belt 111 is at one end of belt 120. The printer paper is deposited in an output paper tray 205.

Figure 2B:
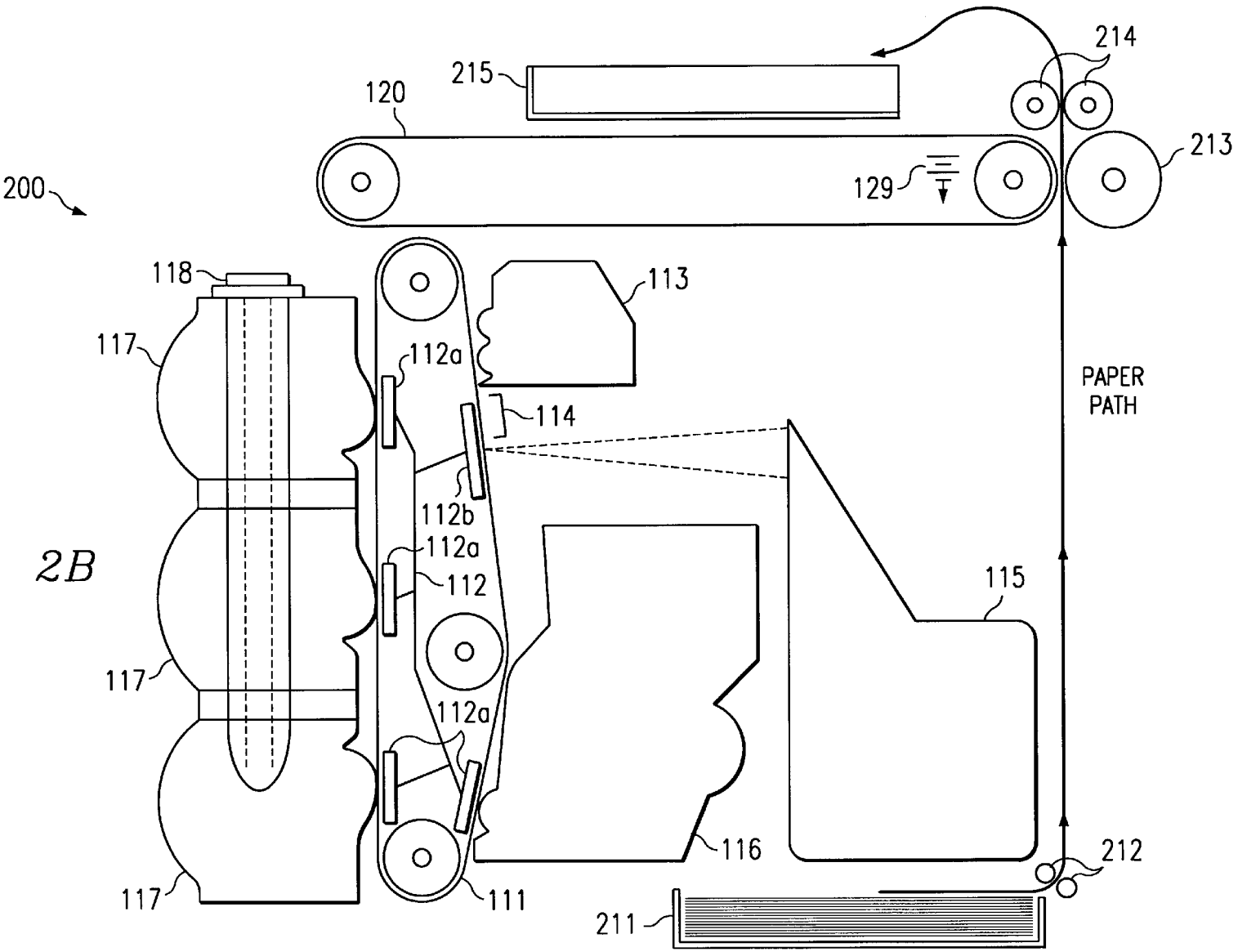

As an alternative to the design of FIG. 2A, where belt 120 is an intermediate belt, printer 200 could have a vertical "bottom to top" paper path, as illustrated in FIG. 2B. In this case, paper would be delivered from a bottom paper tray 211 via rollers 212. The paper travels up the side of the printer 200, through a transfer roller 213 positioned at one end of belt 120. A fuser 214 would be at the top of the printer 200 and printed paper would be deposited in a top paper tray 215.

The embodiments of FIGS. 2A and 2B are consistent with the short, straight, and acessible paper path provided by the "T-shaped" design of belts 111 and 120. All embodiments provide easy access to the paper path and the fuser. The embodiment of FIG. 2B is especially useful for placing the fuser 214 where it is easily vented as well as accessed, thereby preventing the printer and the printed material from being "cooked".

Figure 3:
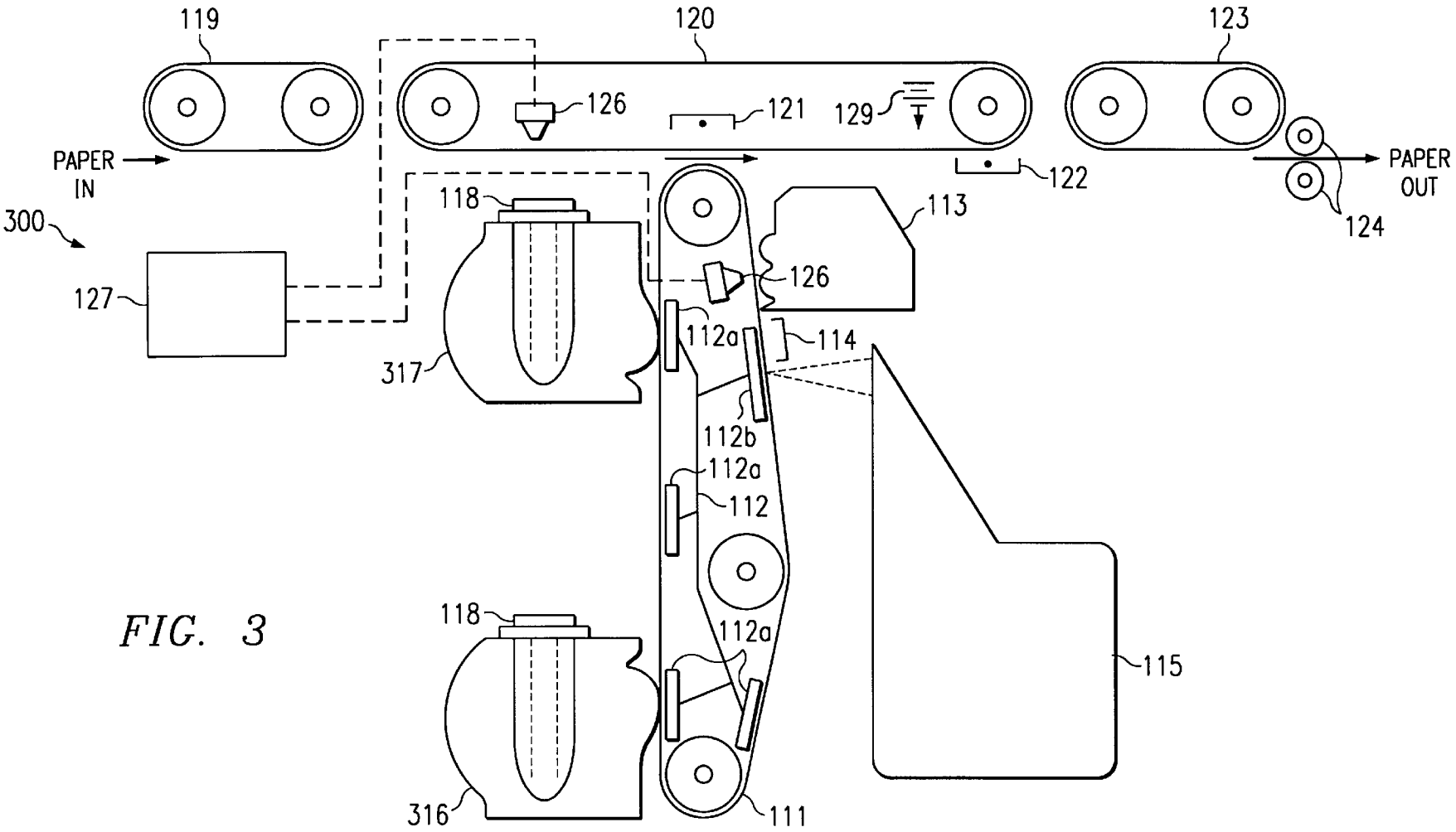
FIG. 3 is an alternative embodiment of the printer of FIG. 1, for spot color printing.

FIG. 3 illustrates a spot color printer 300, which is an alternative embodiment to the full-color printers 100 and 200 of FIGS. 1 and 2. The structure of printer 300 is similar to that of printer 100 except that there is only one color developer cartridge 317 in addition to a black toner cartridge 316. The color toner and the black toner are accumulated on photoreceptor belt 111 before being transferred to belt 120.

In variations of printer 300, there could be more than one color cartridge. However, a common characteristic of all variations is that each color or black is spatially distinct. In other words, toners for different colors or for black are not overlaid on top of each other. Photoreceptor belt 111 makes a single pass past the developer cartridges 317 for each pass of transfer belt 120. There is no need to attach the paper to transfer belt 120 during multiple passes of photoreceptor belt 111.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A develop and transfer assembly for an electrophotographic color printer, comprising:

a photoreceptor belt having a photoconductive outer surface suitable for exposure as a latent image, said photoreceptor belt being substantially oblong in shape, thereby having a long dimension, and being positioned within said printer such that said long dimension is vertical, said photoreceptor belt having an inner surface with an optically readable track indicating a position of said photoreceptor belt in both a process and a cross-process direction;

a number of developer cartridges, adjacent to said outer surface of said photoreceptor belt, each positioned along said long dimension on at least one side of said photoreceptor belt; and a toner transfer belt situated substantially perpendicular to and above said photoreceptor belt, each positioned along said long dimension on at least one side of said photoreceptor belt; and a toner transfer belt situated substantially perpendicular to and above said photoreceptor belt, such that said photoreceptor belt and said transfer belt form a T-shape, said toner transfer belt operable to receive toner from said photoreceptor belt.

2. The assembly of claim 1, wherein said toner transfer belt is operable to carry paper to be printed.

3. The assembly of claim 1, wherein said toner transfer belt is an intermediate media.

4. The assembly of claim 1, wherein said developer cartridges comprise three color developer cartridges, arranged as a stack and vertically positioned along one side of said photoreceptor belt.

5. The assembly of claim 1, wherein said developer cartridges comprise at least one color developer cartridge and a black developer cartridge on opposing sides of said photoreceptor belt.

6. The assembly of claim 1, wherein said transfer belt has an inner surface with an optically readable track.

7. The assembly of claim 1, wherein said printer is a full-color printer, and wherein said transfer belt has an attachment mechanism for attaching said paper to said transfer belt during multiple passes of said photoreceptor belt.

8. The assembly of claim 7, wherein said attachment mechanism comprises a mechanical clamp.

9. The assembly of claim 7, wherein said attachment mechanism comprises an electrostatic mechanism.

10. The assembly of claim 1, wherein said printer is a spot color printer, such that said photoreceptor belt is operable to make one pass for each pass of said transfer belt.

11. The assembly of claim 1, wherein said transfer belt is moveable such that said photoreceptor belt may be accessed from the top of said printer.

12. The assembly of claim 1, wherein a point of transfer of images developed on said photoreceptor belt to said transfer belt is at the top of said photoreceptor belt.

13. A color electrophotographic printer, comprising:

a photoreceptor belt having a photoconductive outer surface suitable for exposure as a latent image, said photoreceptor belt being substantially oblong in shape, thereby having a long dimension, and being positioned within said printer such that said long dimension is vertical;

a number of developer cartridges, adjacent to said outer surface of said photoreceptor belt, each positioned along said long dimension on at least one side of said photoreceptor belt;

a toner transfer belt positioned substantially perpendicular to and above said photoreceptor belt, such that said photoreceptor belt and said transfer belt form a T-shape, said toner transfer belt operable to receive toner from said photoreceptor belt, said toner transfer belt having an inner surface with an optically readable track indicating a position of said toner transfer belt in both a process and a cross-process direction;

an exposure unit operable to expose toner on said photoreceptor belt;

a charging unit operable to charge said photoreceptor belt;

a cleaning unit for cleaning excess toner from said photoreceptor belt; and a fuser for fusing said toner to said paper.

14. The printer of claim 13, wherein said exposure unit comprises a digital micro-mirror device.

15. The printer of claim 13, wherein said toner transfer belt is operable to carry paper to be printed.

16. The printer of claim 13, wherein said toner transfer belt is an intermediate media, and further comprising a paper delivery mechanism above said photoreceptor belt and a transfer roller positioned at one end of said toner transfer belt, such that said printer provides a vertical top-to-bottom paper path.

17. The printer of claim 13, wherein said toner transfer belt is an intermediate media, and further comprising a paper delivery mechanism below said photoreceptor belt and a transfer roller positioned at one end of said toner transfer belt, such that said printer provides a vertical bottom-to-top paper path.

18. The printer of claim 13, wherein said developer cartridges comprise three color developer cartridges, arranged as a stack and vertically positioned along one side of said photoreceptor belt.

19. The printer of claim 13 wherein said printer is a full-color printer, and wherein said transfer belt has an attachment mechanism for attaching said paper to said transfer belt during multiple passes of said photoreceptor belt.

20. The printer of claim 13, wherein said printer is a spot color printer, such that said photoreceptor belt is operable to make one pass for each pass of said transfer belt.

* * * * *